US009308749B2

(12) United States Patent
Saitoh

(10) Patent No.: US 9,308,749 B2
(45) Date of Patent: Apr. 12, 2016

(54) TREATMENT TARGET REFORMING DEVICE, PRINTING APPARATUS, PRINTING SYSTEM, AND PRINTED MATERIAL MANUFACTURING METHOD

(71) Applicant: Haruki Saitoh, Kanagawa (JP)

(72) Inventor: Haruki Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/482,799

(22) Filed: Sep. 10, 2014

(65) Prior Publication Data

US 2015/0077493 A1 Mar. 19, 2015

(30) Foreign Application Priority Data

Sep. 17, 2013 (JP) ..... 2013-192454
Aug. 20, 2014 (JP) ..... 2014-167866

(51) Int. Cl.
*B41J 2/15* (2006.01)
*B41J 11/00* (2006.01)

(52) U.S. Cl.
CPC ..... *B41J 11/0015* (2013.01)

(58) Field of Classification Search
CPC ..... B41J 11/0015; B41J 11/002; B41J 2/01; B41M 7/0072; C09D 11/101
See application file for complete search history.

(56) References Cited

U.S. PATENT DOCUMENTS

| | | | | |
|---|---|---|---|---|
| 2005/0016456 | A1 | 1/2005 | Taguchi et al. | |
| 2006/0042545 | A1 | 3/2006 | Shibata et al. | |
| 2007/0058019 | A1 | 3/2007 | Saitoh et al. | |
| 2007/0163499 | A1 | 7/2007 | Finn et al. | |
| 2008/0239042 | A1 * | 10/2008 | Gauss et al. | 347/101 |
| 2009/0207224 | A1 * | 8/2009 | Cofler | 347/102 |
| 2009/0290007 | A1 | 11/2009 | Saitoh et al. | |
| 2011/0180387 | A1 | 7/2011 | Finn et al. | |
| 2012/0141181 | A1 | 6/2012 | Bisaiji et al. | |
| 2013/0250017 | A1 | 9/2013 | Saitoh et al. | |
| 2014/0078212 | A1 * | 3/2014 | Nakai et al. | 347/16 |

FOREIGN PATENT DOCUMENTS

| | | |
|---|---|---|
| JP | 10-338760 | 12/1998 |
| JP | 2002-058995 | 2/2002 |
| JP | 2004-311116 | 11/2004 |
| JP | 2006-525627 | 11/2006 |
| JP | 3960190 | 8/2007 |
| JP | 4414765 | 11/2009 |
| JP | 2004-311116 | 2/2010 |
| JP | 2010-050106 | 3/2010 |
| JP | 2010-097935 | 4/2010 |
| JP | 2012-099360 | 5/2012 |
| JP | 2012-123062 | 6/2012 |
| JP | 2013-095562 | 5/2013 |

* cited by examiner

*Primary Examiner* — Lamson Nguyen
(74) *Attorney, Agent, or Firm* — Duft Bornsen & Fettig LLP

(57) ABSTRACT

A treatment target reforming device decreases a pH value of a surface of a treatment target using a dielectric-barrier discharge. The treatment target reforming device includes: a discharge electrode and a counter electrode which are disposed so that a conveying path of the treatment target is interposed therebetween; and a power supply which applies a repetitive pulse voltage with an output voltage equal to or larger than 10 kVp-p and smaller than 13 kVp-p to the discharge electrode.

10 Claims, 11 Drawing Sheets

TREATMENT TARGET REFORMING DEVICE, PRINTING APPARATUS, PRINTING SYSTEM, AND PRINTED MATERIAL MANUFACTURING METHOD

CROSS-REFERENCE TO RELATED APPLICATIONS

The present application claims priority to and incorporates by reference the entire contents of Japanese Patent Application No. 2013-192454 filed in Japan on Sep. 17, 2013 and Japanese Patent Application No. 2014-167866 filed in Japan on Aug. 20, 2014.

BACKGROUND OF THE INVENTION

1. Field of the Invention

The present invention relates to a treatment target reforming device, a printing apparatus, a printing system, and a printed material manufacturing method.

2. Description of the Related Art

In an existing inkjet recording apparatus, a shuttle type is mainly used in which a head moves in a reciprocating manner in the width direction of a recording medium represented by paper or a film, and hence the throughput in rapid print processing is not easily improved. Therefore, in recent years, a one-pass type has been proposed in which a plurality of heads are arranged throughout the entire width of a recording medium and the printing is performed at once so as to support repaid print processing.

Here, the one-pass type is advantageous for the rapid print processing. However, since the time interval of striking adjacent dots is short and the adjacent dot is struck before the first struck ink permeate the recording medium, the union of the adjacent dots (hereinafter, referred to as a struck droplet interference) occurs, which degrades an image quality, and thus a problem of beading or bleeding arises.

Further, when print processing is performed on an impermeable medium or a slow permeable medium such as a film or coated paper in an inkjet type printing apparatus, a problem arises in that the adjacent ink dots flow and unite, which causes an image failure due to the beading or the bleeding. As the related art of solving this problem, a method of improving the aggregability and the fixability of the ink by coating a pre-coating agent on the medium in advance and a method of using a UV curable ink are known.

However, in the method of coating a pre-coating agent on the printing medium in advance, there is a need to evaporate and dry the moisture of the pre-coating agent other than the moisture of the ink, and hence the more drying time or the larger drying device is needed. Further, in the method of using the comparatively expensive UV curable ink or the pre-coating agent being a supply article, a problem arises in that the printing cost increases.

In view of the above, there is a need to provide a treatment target reforming device, a printing apparatus, a printing system, and a printed material manufacturing method capable of manufacturing a high-quality printed material while suppressing an increase in cost.

SUMMARY OF THE INVENTION

It is an object of the present invention to at least partially solve the problems in the conventional technology.

A treatment target reforming device decreases a pH value of a surface of a treatment target using a dielectric-barrier discharge. The treatment target reforming device includes: a discharge electrode and a counter electrode which are disposed so that a conveying path of the treatment target is interposed therebetween; and a power supply which applies a repetitive pulse voltage with an output voltage equal to or larger than 10 kVp-p and smaller than 13 kVp-p to the discharge electrode.

A printing system includes: a treatment target reforming device which decreases a pH value of a surface of a treatment target using a dielectric-barrier discharge; a recording device which performs inkjet recording on the surface of the treatment target reformed by the treatment target reforming device, a discharge electrode and a counter electrode which are disposed so that a conveying path of the treatment target is interposed therebetween; and a power supply which applies a repetitive pulse voltage with an output voltage equal to or larger than 10 kVp-p and smaller than 13 kVp-p to the discharge electrode.

A printed material manufacturing method uses a treatment target reforming device which decreases a pH value of a surface of a treatment target using a dielectric-barrier discharge and a recording device which performs inkjet recording on the surface of the treatment target reformed by the treatment target reforming device. The printed material manufacturing method includes: conveying the treatment target along a conveying path; applying a repetitive pulse voltage with an output voltage equal to or larger than 10 kVp-p and smaller than 13 kVp-p to a discharge electrode and a counter electrode disposed so that the conveying path is interposed therebetween; and performing inkjet recording on the surface of the treatment target reformed at the applying.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
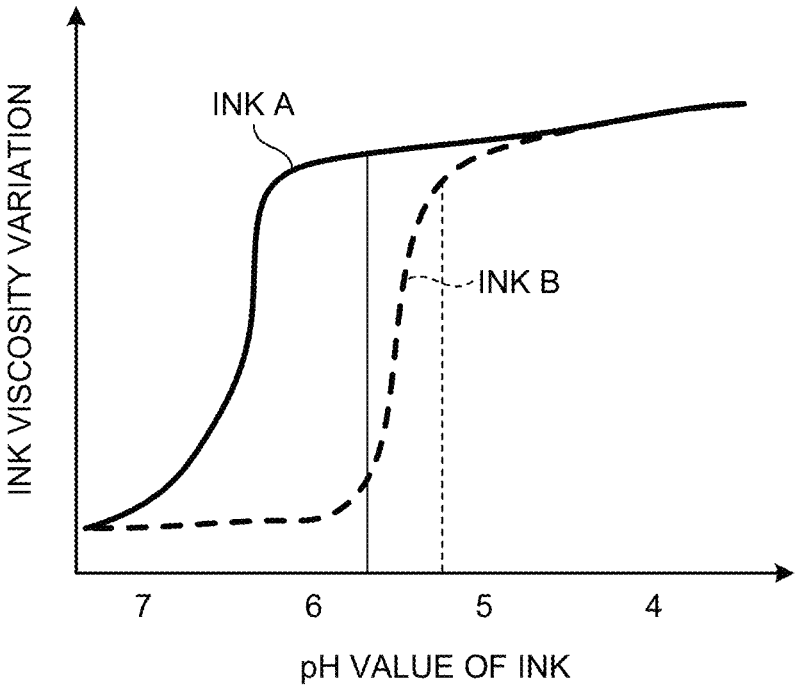
FIG. 1 is a diagram illustrating an example of a relation between the pH value and the viscosity of an ink of an embodiment.

Hereinafter, preferred embodiments of the invention will be described in detail with reference to the accompanying drawings. Furthermore, since the embodiment mentioned below is the preferred embodiment of the invention, the embodiment is limited technically in various ways. However, the scope of the invention is not unreasonably limited to the description below, and all components described in the embodiment are not essentially needed in the invention.

In the embodiment below, a surface of a treatment target is acidified in order to aggregate an ink pigment while preventing the dispersion of the pigment immediately after an ink is struck on a treatment target (also referred to as a recording medium or a printing medium). As the acidifying means, plasma treatment is exemplified.

Further, in the embodiment below, the circularity of an ink dot (hereinafter, simply referred to as a dot) is improved and the union of the dot is prevented to improve the sharpness or the color gamut of the dot by controlling the aggregability or the permeability of the ink pigment due to a decrease in the pH value and the wettability of the surface of the treatment target subjected to plasma treatment. Accordingly, it is possible to obtain a printed material having a high-quality image formed thereon by solving an image failure called beading or bleeding. Further, it is possible to decrease the quantity of an ink liquid droplet by thinning and equalizing the thickness of the pigment aggregated on the treatment target, and hence to decrease ink dry energy and printing cost.

In plasma treatment as an acidifying means (process), macromolecules of the surface of the treatment target are reacted to form a hydrophilic functional group by irradiating plasma in atmosphere to the treatment target. Specifically, electrons e emitted from a discharge electrode are accelerated within an electric field, and hence excite and ionize atoms or molecules in atmosphere. Electrons are also emitted from the ionized atoms or molecules, and high-energy electrons increase in number, so that a streamer discharge (plasma) is generated. The polymer bonding (calcium carbonate together with a starch as a binder is bound in a coated layer of coated paper, and the starch has a macromolecular architecture) of the surface of the treatment target (for example, coated paper) is broken by the high-energy electrons generated by the streamer discharge, and is recombined with oxygen radical O* or hydroxyl radical (—OH) and ozone $O_3$ in the gas-phase. These processes are called plasma treatment. Accordingly, a polar functional group such as a hydroxyl group or a carboxyl group is formed on the surface of the treatment target. As a result, a hydrophilic property and an acidic property are given to a surface of a printing medium. It is noted that the surface of the printing medium is acidified (while the pH value thereof decreases) with an increase in the number of the carboxyl groups.

It was found to be important to aggregate a colorant (for example, a pigment or a dye) within dots, and cause a vehicle to be dried or to permeate the treatment target more rapidly than the vehicle wets and spreads in order to prevent the colors of adjacent dots from being mixed with each other due to that the adjacent dots on the treatment target wet and spread as the hydrophilic property becomes strong, and unites. Therefore, in the embodiment, acidifying treatment of acidifying the surface of the treatment target is performed as pretreatment of inkjet recording processing.

The acidifying in the description means that the pH value of the surface of the printing medium decreases to the pH value at which the pigment contained in the ink is aggregated. A decrease in pH value indicates that the concentration of a hydrogen ion $H^+$ in an object increases. The pigment in the ink is charged to minus before contacting the surface of the treatment target, and the pigment in the vehicle is dispersed. FIG. 1 illustrates an example of a relation between the pH value and the viscosity of the ink. As illustrated in FIG. 1, the viscosity of the ink increases as the pH value thereof decreases. This is because the pigment charged to minus in the vehicle of the ink is electrically more neutralized as the acidity of the ink increases so that the pigment is aggregated. Accordingly, it is possible to increase the viscosity of the ink by decreasing the pH value of the surface of the printing medium so that the pH value of the ink comes to correspond to the necessary viscosity, for example, in the graph illustrated in FIG. 1. This is because the pigment is electrically neutralized by the hydrogen ion H+ of the surface of the printing medium so that the pigment is aggregated when the ink is stuck to the surface of the printing medium having an acidic property. Accordingly, it is possible to prevent the colors of the adjacent dots from being mixed with each other and to prevent the pigment from deeply permeating the printing medium (to the rear surface thereof). However, there is a need to decrease the pH value of the surface of the printing medium so as to be lower than the pH value of the ink corresponding to the necessary viscosity in order to decrease the pH value of the ink to the pH value corresponding to the necessary viscosity.

Further, the pH value for allowing the ink to have necessary viscosity is different depending on the property of the ink. That is, there exist an ink in which the viscosity increases by the aggregation of the pigment at the pH value relatively close to neutral as illustrated in the ink A of FIG. 1, as well as an ink which needs a pH value lower than the ink A in order to aggregate the pigment as illustrated in the ink B having a property different from the ink A.

The behavior in which the colorant is aggregated within the dot, the vehicle drying speed, or the speed in which the vehicle permeates the treatment target is different depending on the quantity of the liquid droplet changing by the size (the small size, the middle size, and the large size) of the dot or on the type of treatment target. Therefore, in the embodiment below, the quantity of the plasma energy in the plasma treatment may be controlled to an optimal value in accordance with the type of treatment target or the printing mode (the quantity of the liquid droplet).

Figure 2:
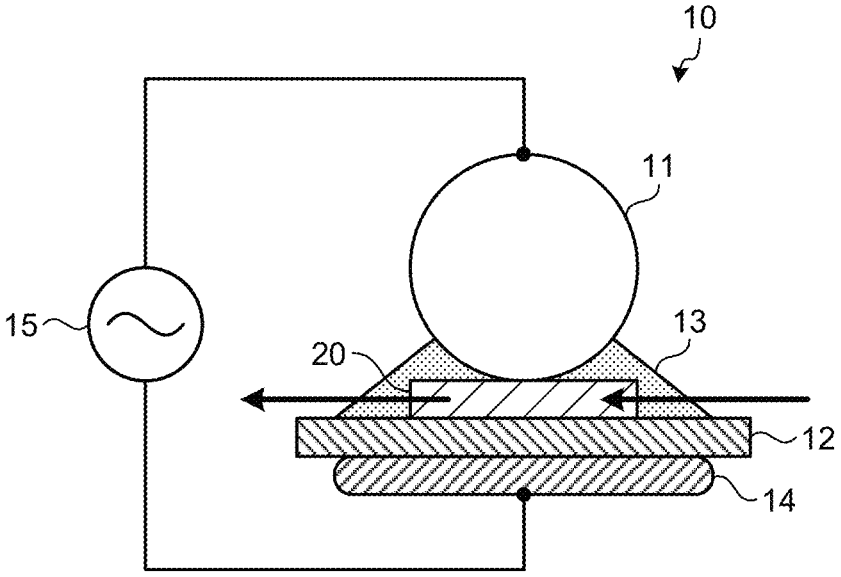
FIG. 2 is a schematic diagram illustrating an example of a plasma treatment apparatus according to the embodiment.

FIG. 2 is a schematic diagram illustrating acidifying treatment employed in the embodiment. As illustrated in FIG. 2, a plasma treatment apparatus 10 including a discharge electrode 11, a counter electrode 14, a dielectric body 12, and a high-frequency and high-voltage power source 15 is used in the acidifying treatment employed in the embodiment. In the plasma treatment apparatus 10, the dielectric body 12 is disposed between the discharge electrode 11 and the counter electrode 14. Each of the discharge electrode 11 and the counter electrode 14 may be an electrode in which a metal part is exposed or an electrode which is coated by an insulating body or a dielectric body such as insulating rubber or ceramic. Further, the dielectric body 12 which is disposed between the discharge electrode 11 and the counter electrode 14 may be an insulating body such as polyimide, silicon, and ceramic. Furthermore, when a corona discharge is employed as the plasma treatment, the dielectric body 12 may not be provided. However, it may be desirable to provide the dielectric body 12, for example, when a dielectric-barrier discharge is employed. In that case, the effect of the plasma treatment is improved by disposing the dielectric body 12 near or to contact the counter electrode 14 rather than near or to contact the discharge electrode 11, because the area of the creeping discharge is widened. Further, the discharge electrode 11 and the counter electrode 14 (or the dielectric body 12 in the case of the electrode provided with the dielectric body 12) may be disposed at the position where they contact a treatment target 20 passing between both electrodes or the position where they do not contact the treatment target.

The high-frequency and high-voltage power source 15 applies a high-frequency and high-voltage repetitive pulse voltage across the discharge electrode 11 and the counter electrode 14. The voltage value of the repetitive pulse voltage is, for example, about 10 kV (kilovolt) p-p. Further, the frequency may be set to, for example, about 20 kHz (kilohertz). When the high-frequency and high-voltage repetitive pulse voltage is supplied across two electrodes, atmospheric non-equilibrium plasma 13 is generated between the discharge electrode 11 and the dielectric body 12. The treatment target 20 passes between the discharge electrode 11 and the dielectric body 12 while the atmospheric non-equilibrium plasma 13 is generated. Accordingly, the surface of the treatment target 20 near the discharge electrode 11 is subjected to the plasma treatment.

Furthermore, the rotary discharge electrode 11 and the belt conveyor type dielectric body 12 are employed in the plasma treatment apparatus 10 exemplified in FIG. 2. The treatment target 20 passes through the atmospheric non-equilibrium plasma 13 while being nipped and conveyed between the rotating discharge electrode 11 and the dielectric body 12. Accordingly, the surface of the treatment target 20 contacts the atmospheric non-equilibrium plasma 13, so that a uniform plasma treatment is performed thereon. However, the configuration of the plasma treatment apparatus employed in the embodiment is not limited to the configuration illustrated in FIG. 2. For example, the configuration may be modified into various forms so that the discharge electrode 11 is close to the treatment target 20 without contacting the treatment target or the discharge electrode 11 is mounted on a carriage such as an inkjet head. Further, the invention is not limited to the belt conveyor type dielectric body 12, and the flat dielectric body 12 may be also employed.

Figure 3:
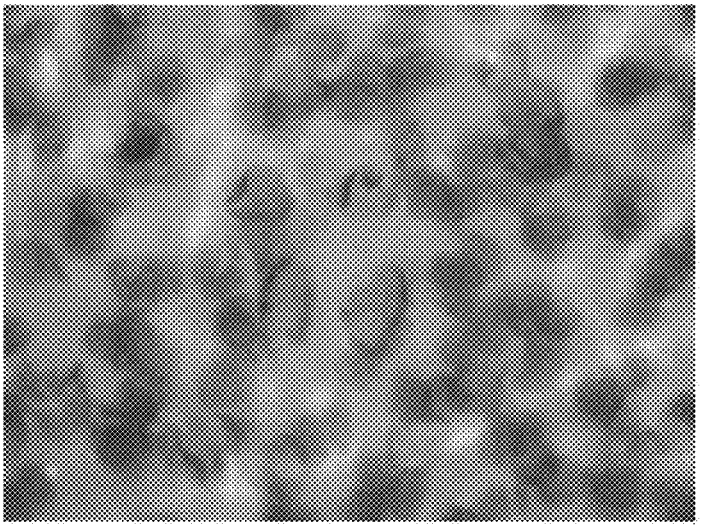
FIG. 3 is an enlarged diagram of an image that is obtained by capturing an image of an image formation surface of a printed material obtained by performing inkjet recording processing on a treatment target which is not subjected to plasma treatment according to the embodiment.
Figure 4:
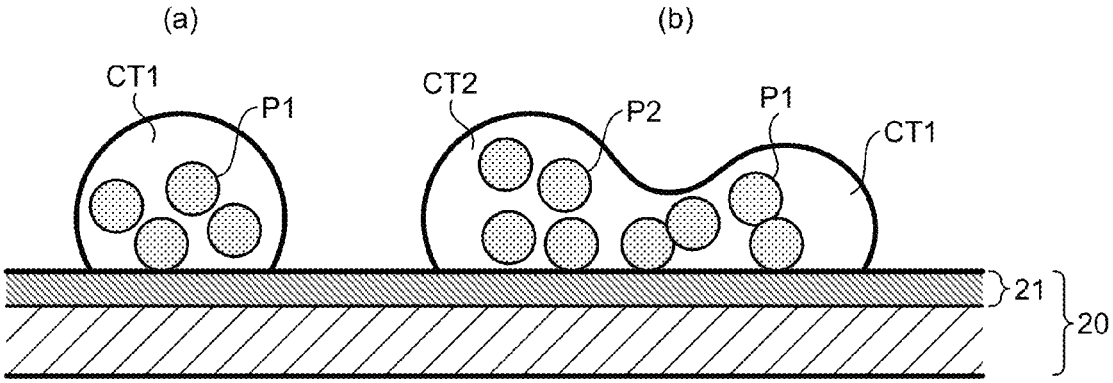
FIG. 4 is a schematic diagram illustrating an example of dots formed on the image formation surface of the printed material illustrated in FIG. 3.
Figure 5:
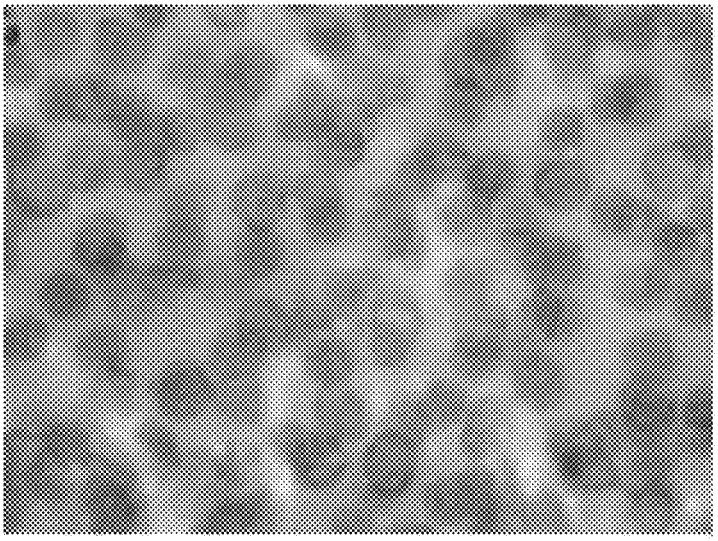
FIG. 5 is an enlarged diagram of an image that is obtained by capturing an image of an image formation surface of a printed material obtained by performing inkjet recording processing on the treatment target which is subjected to the plasma treatment according to the embodiment.
Figure 6:
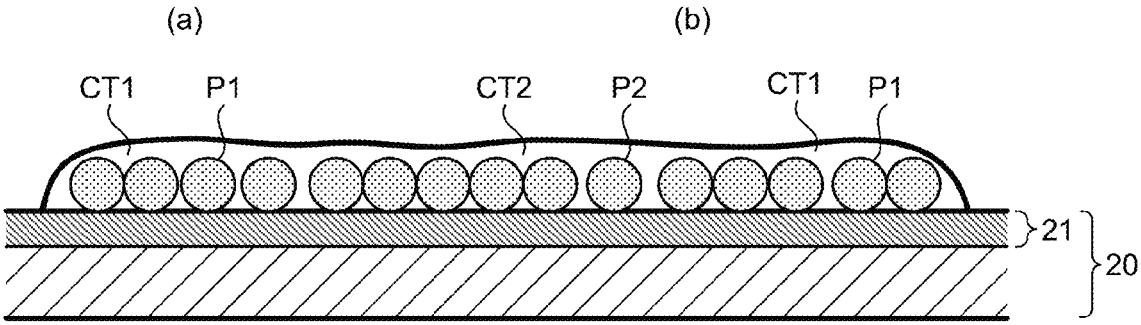
FIG. 6 is a schematic diagram illustrating an example of dots formed on the image formation surface of the printed material illustrated in FIG. 5.

Here, a difference in printed material depending on whether the plasma treatment according to the embodiment is performed on the printed material or is not performed thereon will be described with reference to FIGS. 3 to 6. FIG. 3 is an enlarged diagram of an image that is obtained by capturing an image of an image formation surface of a printed material obtained by performing inkjet recording processing on a treatment target which is not subjected to plasma treatment according to the embodiment, and FIG. 4 is a schematic diagram illustrating an example of a dot formed on the image formation surface of the printed material illustrated in FIG. 3. FIG. 5 is an enlarged diagram of an image that is obtained by capturing an image of an image formation surface of a printed material obtained by performing inkjet recording processing on the treatment target which is subjected to the plasma treatment according to the embodiment, and FIG. 6 is a schematic diagram illustrating an example of a dot formed on the image formation surface of the printed material illustrated in FIG. 5. In is noted that a desktop type inkjet recording apparatus is used to obtain the printed materials illustrated in FIGS. 3 and 5. Further, general coated paper having a coated layer is used in the treatment target 20.

In the coated paper which is not subjected to the plasma treatment according to the embodiment, the wettability of the coated layer of the surface of the coated paper is poor. For that reason, in an image which is formed by the inkjet recording processing on the coated paper not subjected to the plasma treatment, the shape of the dot (the shape of the vehicle CT1) stuck to the surface of the coated paper at the time of striking of the dots is distorted, for example, as illustrated in FIGS. 3 and 4. Further, when the adjacent dots are formed while the dots are not sufficiently dried, the vehicles CT1 and CT2 are united at the time of striking of the adjacent dots on the coated paper as illustrated in FIGS. 3 and 4, and hence movement of the pigments P1 and P2 between the dots (color mixing) occurs. As a result, a variation in concentration may occur due to the beading or the like.

Meanwhile, in the coated paper subjected to the plasma treatment according to the embodiment, the wettability of the coated layer of the surface of the coated paper is improved. For that reason, in an image which is formed by the inkjet recording processing on the coated paper subjected to the plasma treatment, the vehicle CT1 spreads in a comparatively true circle shape on the surface of the coated paper, for example, as illustrated in FIG. 5. Accordingly, the dot becomes flat as illustrated in FIG. 6. Further, since the surface of the coated paper is acidified by the polar functional group formed by the plasma treatment, the ink pigment is electrically neutralized, and the pigment P1 is aggregated, so that the viscosity of the ink is improved. Accordingly, even when the vehicles CT1 and CT2 are united as illustrated in FIG. 6, it is possible to suppress movement of the pigments P1 and P2 between the dots (color mixing). Further, since the polar functional group is formed even inside the coated layer, the permeability of the vehicle CT1 is improved. Accordingly, the ink can be dried in a comparatively short time. Since the dot which spreads in a true circle shape due to the improved wettability is aggregated while permeating, the pigment P1 is uniformly aggregated in the height direction, and hence occurrence of variation in concentration due to the beading or the like can be suppressed. Furthermore, FIGS. 4 and 6 are schematic diagrams, and the pigment is actually aggregated to form layers even in the case of FIG. 6.

In this way, in the treatment target 20 subjected to the plasma treatment according to the embodiment, a functional group having a hydrophilic property is formed on the surface of the treatment target 20 by the plasma treatment, and hence the wettability is improved. Further, since the polar functional group is formed by the plasma treatment, the surface of the treatment target 20 is acidified. Accordingly, since the pigment which is charged to minus is neutralized on the surface of the treatment target 20 while the struck ink uniformly spreads on the surface of the treatment target 20, the viscosity of the ink is improved by the aggregation. As a result, the movement of the pigment can be suppressed even when the dots are united. Further, since the polar functional group is formed even inside the coated layer formed on the surface of the treatment target 20, the vehicle promptly permeates the treatment target 20, and hence the drying time can be shortened. That is, since the dot which spreads in a true circle shape due to the improved wettability permeates the treatment target while the movement of the pigment is suppressed by the aggregation, the true circle shape can be substantially maintained.

Figure 7:
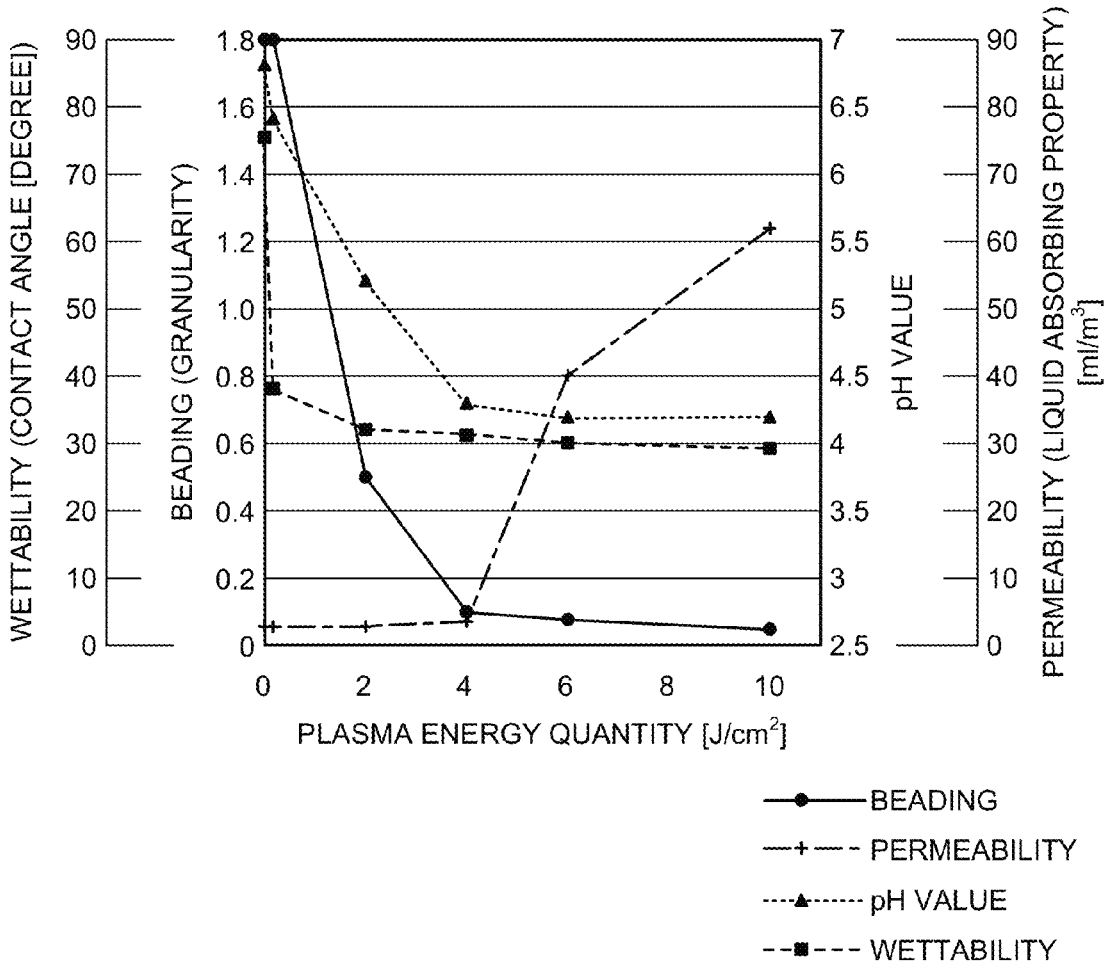
FIG. 7 is a graph illustrating a relation between a plasma energy quantity and each of the wettability, the beading, the pH value, and the permeability of a surface of a treatment target according to the embodiment.

FIG. 7 is a graph illustrating a relation between a plasma energy quantity and each of the wettability, the beading, the pH value, and the permeability of a surface of a treatment target according to the embodiment. FIG. 7 illustrates how the surface properties (the wettability, the beading, the pH value, and the permeability (the liquid absorbing property)) change depending on the plasma energy quantity when the printing process is performed on the coated paper as the treatment target 20. Furthermore, in order to obtain the evaluation illustrated in FIG. 7, an aqueous pigment ink having a property in which a pigment is aggregated by an acid (an alkaline ink in which a pigment charged to minus is dispersed) is used as the ink.

As illustrated in FIG. 7, the wettability of the surface of the coated paper is drastically improved when the plasma energy quantity is a low value (for example, about 0.2 J/cm$^2$ or less), and is not improved any more even when the energy is increased further. Meanwhile, the pH value of the surface of the coated paper is decreased to a certain degree by increasing the plasma energy quantity. However, when the plasma energy quantity exceeds a certain value (for example, about 4 J/cm$^2$), the pH value is saturated. Further, the permeability (the liquid absorbing property) is drastically improved from the vicinity (for example, about 4 J/cm$^2$) at which a decrease in pH value is saturated. However, this phenomenon is different depending on the macromolecular component contained in the ink.

As a result, and the value of the beading (the granularity) becomes very good from when the permeability (the liquid absorbing property) becomes good (for example, about 4 J/cm2). Here, the beading (the granularity) expresses the surface roughness of the image with a numerical value by expressing variation in concentration by a standard deviation of an average concentration. In FIG. 7, the standard deviation of the concentration when the concentration of a solid image of a color having two colors or more of dots is sampled plural times is illustrated as the beading (the granularity). In this way, since the ink which is ejected to the coated paper subjected to the plasma treatment according to the embodiment permeates the coated paper while spreading in a true circle shape and being aggregated, the beading (the granularity) of the image is improved.

As described above, regarding the relation between the property of the surface of the treatment target 20 and the image quality, the circularity of the dot is improved when the wettability of the surface is improved. This is because due to the plasma treatment, the surface roughness is increased, the wettability of the surface of the treatment target 20 is improved by the polar functional group of the hydrophilic property, and these are equalized. Further, it can be also thought as a factor that a water repellent factor such as dust, oil, or calcium carbonate on the surface of the treatment target 20 is eliminated by the plasma treatment. That is, since the unstable factor of the surface of the treatment target 20 is removed while the wettability of the surface of the treatment target 20 is improved, the liquid droplet spreads uniformly in the circumferential direction, and hence the circularity of the dot is improved.

Further, acidification of the surface of the treatment target 20 (decrease in the pH value) causes the aggregation of the ink pigment, improvement of the permeability, permeation of the vehicle into the coated layer, and the like. Accordingly, since the pigment concentration of the surface of the treatment target 20 increases, the movement of the pigment can be suppressed even when the dots are united. As a result, it is possible to suppress the pigment from getting muddy, and hence to uniformly settle and aggregate the pigment on the surface of the treatment target 20. However, the effect of suppressing the pigment from getting muddy is different depending on the component of the ink or the quantity of the ink droplet. For example, when the quantity of the ink droplet is a small droplet, the pigment does not easily get muddy due to the union of the dot compared to the case of a large droplet. This is because the vehicle permeates and is dried fast and the pigment is aggregated by a slight pH reaction in the case where the vehicle quantity is a small droplet. Furthermore, the effect of the plasma treatment changes depending on the type or the environment (the humidity or the like) of the treatment target 20. Therefore, the plasma energy quantity during the plasma treatment may be controlled to an optimal value in accordance with the quantity of the liquid droplet or the type of the treatment target 20 or the environment. As a result, the efficiency of reforming the surface of the treatment target 20 is improved, and energy can be further saved.

Figure 8:
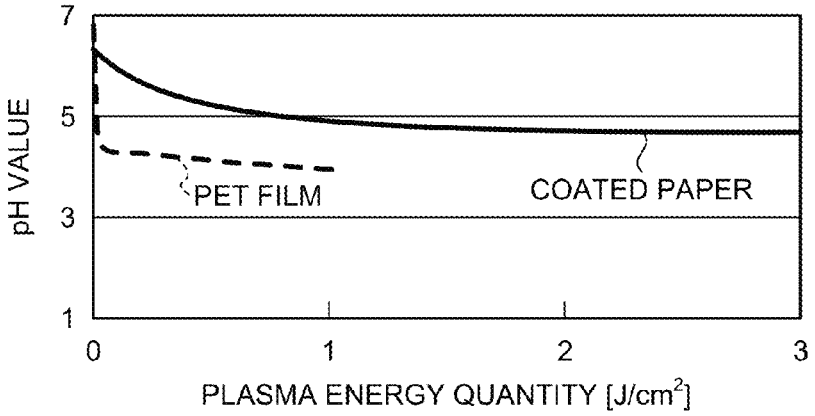
FIG. 8 is a diagram illustrating an example of a relation between the plasma energy quantity of each medium and the pH value of the surface of the treatment target.

Further, FIG. 8 is a graph illustrating a relation between the plasma energy quantity and the pH value according to the embodiment. In most cases, it is general that the pH value is measured in a liquid. However, the pH value may be measured on a surface of a solid in recent years. As the measurement unit, for example, there is known a pH meter "B-211" manufactured by HORIBA, LTD.

In FIG. 8, the solid line indicates the plasma energy dependence property of the pH value of the coated paper, and the dotted line indicates the plasma energy dependence property of the pH value of the PET film. As illustrated in FIG. 8, the PET film is acidified by a little plasma energy quantity compared to the coated paper. However, even in the coated paper, the plasma energy quantity for the acidifying treatment was 3 J/cm$^2$ or less. Then, when an image is recorded on the treatment target 20 in which the pH value becomes 5 or less by an inkjet processing apparatus that ejects an alkaline aqueous pigment ink, the dot of the image formed thereon is substantially formed in a true circle shape. Further, the pigment does not get muddy due to the union of the dot, and hence a satisfactory image without any bleeding can be obtained (see FIG. 5).

Next, a treatment target reforming device, a printing apparatus, a printing system, and a printed material manufacturing method according to the embodiment of the invention will be described in detail with reference to the drawings.

Furthermore, in the embodiment, an image forming apparatus including ejection heads (recording heads or ink heads) of four colors, that is, black (K), cyan (C), magenta (M), and yellow (Y) will be described, but the invention is not limited to these ejection heads. That is, the image forming apparatus may further include ejection heads corresponding to green (G), red (R), and the other colors or may include an ejection head of only black (K). Here, in the description below, K, C, M, and Y respectively correspond to black, cyan, magenta, and yellow.

Further, in the embodiment, a continuous sheet (hereinafter, referred to as a rolled sheet) which is wound in a roll shape is used as the treatment target, but the invention is not limited thereto. For example, a recording medium such as a cut sheet on which an image may be formed may be employed. Then, in the case of paper, for example, standard paper, high-quality paper, recycled paper, thin paper, thick paper, coated paper, or the like may be used. Further, an OHP sheet, a synthetic resin film, a thin metal film, and a sheet on which an image may be formed on the surface thereof by an ink or the like may be used as the treatment target. When the paper is coated paper having an impermeable property and a slow permeable property, the effect of the invention is further exhibited. Here, the rolled paper may be a continuous sheet (continuous form paper or continuous slip) in which cuttable perforation lines are formed at a predetermined interval. In that case, the page of the rolled paper indicates, for example, an area which is interposed between the perforation lines formed at a predetermined interval.

Figure 9:
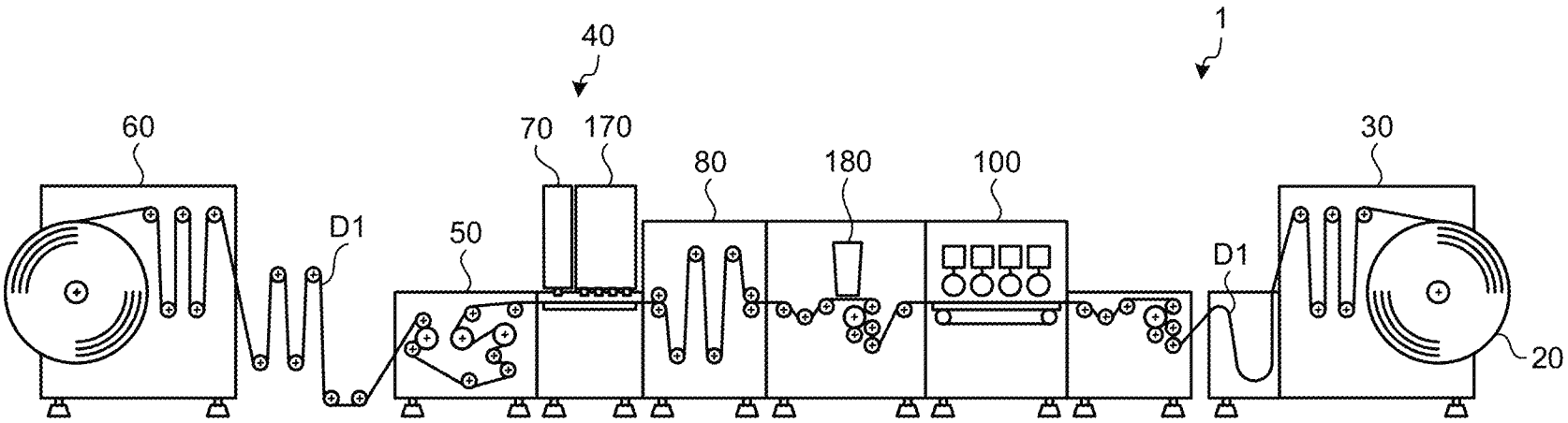
FIG. 9 is a schematic diagram illustrating the schematic configuration of a printing apparatus (system) according to the embodiment.

FIG. 9 is a schematic diagram illustrating the schematic configuration of a printing apparatus (system) according to the embodiment. As illustrated in FIG. 9, a printing apparatus (system) 1 includes an introduction unit 30 which introduces (conveys) the treatment target 20 (the rolled paper) along a conveying path D1, a plasma treatment apparatus 100 which performs plasma treatment as pretreatment on the introduced treatment target 20, and an image forming apparatus 40 which forms an image on the surface of the treatment target 20 subjected to the plasma treatment. These apparatuses may constitute the system while being provided with an independent housing or may constitute a printing apparatus while being accommodated in the same housing. Further, in the configuration of the printing system, a control unit which controls a part or the entirety of the system may be included in a certain apparatus or may be provided in an independently separate housing.

A buffer unit 80 which adjusts the feeding amount of the treatment target 20 after subjected to pretreatment such as plasma treatment with respect to an inkjet recording apparatus 170 is provided between the plasma treatment apparatus 100 and the inkjet recording apparatus 170. Further, the image forming apparatus 40 includes the inkjet recording apparatus 170 which forms an image by the inkjet process on the treatment target 20 subjected to the plasma treatment. The image forming apparatus 40 may further include a post-process unit 70 which post-processes the treatment target 20 having an image formed thereon.

Furthermore, the printing apparatus (system) 1 may include a drying unit 50 which dries the treatment target 20 subjected to a post-process and a discharge unit 60 which discharges the treatment target 20 having an image formed thereon (and subjected to a post-process in some cases). Further, the printing apparatus (system) 1 may further include a pre-coating process unit (not illustrated) which coats a process liquid called a pre-coating agent containing a macromolecular material in the surface of the treatment target 20 other than the plasma treatment apparatus 100 as a pretreatment unit that performs pretreatment on the treatment target 20. Furthermore, a pH detection unit 180 which detects the pH value of the surface of the treatment target 20 subjected to the pretreatment by the plasma treatment apparatus 100 may be provided between the plasma treatment apparatus 100 and the image forming apparatus 40.

Further, the printing apparatus (system) 1 includes a control unit (not illustrated) which controls the operation of each component. For example, the control unit may be connected to a printing control device which generates last data from image data of a printing target. The printing control device may be provided inside the printing apparatus (system) 1 or may be provided at the outside via a network such as an internet or a LAN (Local Area Network).

In the embodiment, in the printing apparatus (system) 1 illustrated in FIG. 9, the acidifying treatment of acidifying the surface of the treatment target is performed before the inkjet recording processing as described above. In the acidifying treatment, for example, atmospheric non-equilibrium plasma treatment using a dielectric-barrier discharge may be employed. The acidifying treatment which is performed by the atmospheric non-equilibrium plasma is one of preferred methods as a plasma treatment method for the treatment target such as a recording medium in that the temperature of an electron is extremely high and the temperature of a gas is close to a normal temperature.

In order to widely and stably generate the atmospheric non-equilibrium plasma, atmospheric non-equilibrium plasma treatment using a streamer insulation breakdown type dielectric-barrier discharge may be performed. For example, the streamer insulation breakdown type dielectric-barrier discharge may be performed by alternately applying a high voltage across electrodes coated by a dielectric body.

Furthermore, as a method of generating the atmospheric non-equilibrium plasma, various methods may be used other than the above-described streamer insulation breakdown type dielectric-barrier discharge. For example, a dielectric-barrier discharge in which an insulating material such as a dielectric body is inserted between electrodes, a corona discharge which forms a noticeable non-equilibrium electric field in a thin metal wire or the like, or a pulse discharge which applies a short pulse voltage may be employed. Further, two or more of these methods may be combined.

Figure 10:
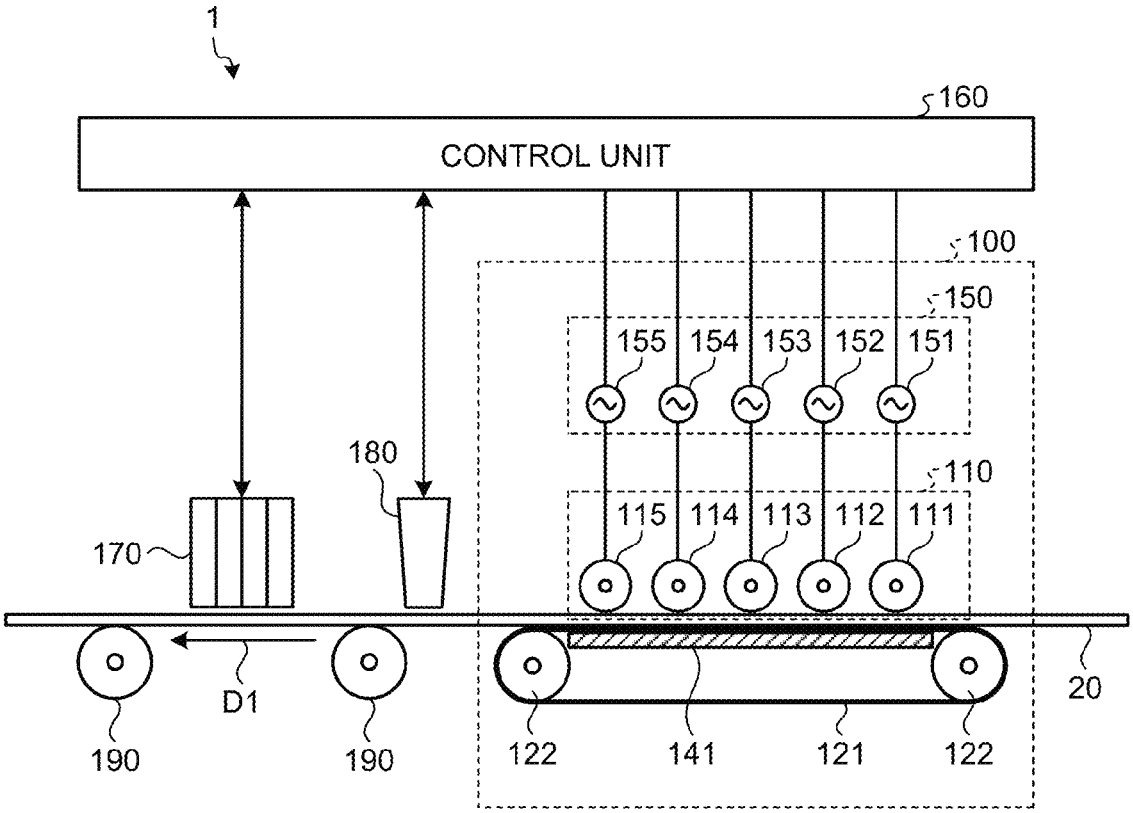
FIG. 10 is a schematic diagram selectively illustrating the configuration from the plasma treatment apparatus to an inkjet recording apparatus in the printing apparatus (system) according to the embodiment.

Subsequently, the configuration from the plasma treatment apparatus 100 to the inkjet recording apparatus 170 in the printing apparatus (system) 1 illustrated in FIG. 9 is selectively illustrated in FIG. 10. As illustrated in FIG. 10, the printing apparatus (system) 1 includes the plasma treatment apparatus 100 which performs plasma treatment on the surface of the treatment target 20, the pH detection unit 180 which measures the pH value of the surface of the treatment target 20, the inkjet recording apparatus 170 which forms an image on the treatment target 20 by the inkjet recording, and a control unit 160 which controls the entire printing apparatus (system) 1. Further, the printing apparatus (system) 1 includes a conveying roller 190 which conveys the treatment target 20 along the conveying path D1. For example, the conveying roller 190 conveys the treatment target 20 along the conveying path D1 while being rotationally driven according to the control from the control unit 160.

Similarly to the atmospheric non-equilibrium plasma treatment apparatus 10 illustrated in FIG. 2, the plasma treatment apparatus 100 includes a discharge electrode 110, a counter electrode 141, a high-frequency and high-voltage power source 150, and a dielectric belt 121 interposed between the electrodes. However, in FIG. 10, the discharge electrode 110 includes five discharge electrodes 111 to 115, and the counter electrode 141 is provided in the entire area interposed between each of the discharge electrodes 111 to 115 and the dielectric belt 121. Further, the high-frequency and high-voltage power source 150 includes five high-frequency and high-voltage power sources 151 to 155 according to the number of the discharge electrodes 111 to 115.

As the dielectric belt 121, an endless belt may be used so that the dielectric belt is also used to convey the treatment target 20. Therefore, the plasma treatment apparatus 100 further includes a rotation roller 122 which conveys the treatment target 20 by rotating the dielectric belt 121. The rotation roller 122 rotates the dielectric belt 121 while being rotationally driven by the instruction from the control unit 160. Accordingly, the treatment target 20 is conveyed along the conveying path D1.

The control unit 160 may individually turn on or off the high-frequency and high-voltage power sources 151 to 155. Further, the control unit 160 may adjust the pulse strength of the high-frequency and high-voltage pulse supplied from each of the high-frequency and high-voltage power sources 151 to 155 to each of the discharge electrodes 111 to 115.

The pH detection unit 180 is disposed at the downstream side in relation to the plasma treatment apparatus 100 and a pre-coating device (not illustrated). Then, the pH detection unit may detect the pH value of the surface of the treatment target 20 subjected to the pretreatment (the acidifying treatment) performed by the plasma treatment apparatus 100 and/or the pre-coating device and may input the pH value to the control unit 160. On the contrary, the control unit 160 may adjust the pH value of the surface of the treatment target 20 subjected to the pretreatment by performing a feedback control on the plasma treatment apparatus 100 and/or the pre-coating device (not illustrated) based on the pH value input from the pH detection unit 180.

Furthermore, the plasma energy quantity necessary for the plasma treatment may be obtained from, for example, the voltage value and the application time of the high-frequency and high-voltage pulse supplied from each of the high-frequency and high-voltage power sources 151 to 155 to each of the discharge electrodes 111 to 115 and the current flowing to the treatment target 20 at that time. Furthermore, the plasma energy quantity necessary for the plasma treatment may be controlled by the energy quantity of the entire discharge electrode 110 instead of each of the discharge electrodes 111 to 115.

The treatment target 20 is subjected to the plasma treatment while passing between the discharge electrode 110 and the dielectric belt 121 while plasma is generated in the plasma treatment apparatus 100. Accordingly, when the chain of the binder resin of the surface of the treatment target 20 is broken and the gas-phase oxygen radical or ozone is recombined with macromolecules, a polar functional group is formed on the surface of the treatment target 20. As a result, a hydrophilic property and an acid property are given to the surface of the treatment target 20. Furthermore, in this example, the plasma treatment is performed in atmosphere, but may be performed in a gas such as a nitrogen gas or a rare gas.

Further, it is effective to include the discharge electrodes 111 to 115 in that the surface of the treatment target 20 is uniformly acidified. That is, for example, when the same conveying speed (or the same printing speed) is set, it is possible to extend the time in which the treatment target 20 passes through the space of the plasma in the case where the acidifying treatment is performed by the discharge electrodes compared to the case where the acidifying treatment is performed by one discharge electrode. As a result, it is possible to further uniformly acidify the surface of the treatment target 20.

The inkjet recording apparatus 170 includes an inkjet head. The inkjet head includes, for example, a plurality of heads (for example, four colors by four heads) of the same color in order to increase the printing speed. Further, in order to rapidly form an image by a high resolution (for example, 1200 dpi), the ink ejection nozzles of the heads of different colors are fixed while being deviated from each other so that the gap is corrected. Furthermore, the inkjet heads may be driven at a plurality of driving frequencies so that each of the dots (the liquid droplets) of the ink ejected from the nozzles corresponds to three kinds of quantity called large, middle, and small liquid droplets.

The inkjet head 171 is disposed at the downstream side in relation to the plasma treatment apparatus 100 on the conveying path of the treatment target 20. The inkjet recording apparatus 170 forms an image by ejecting an ink to the treatment target 20 subjected to the pretreatment (the acidifying treatment) by the plasma treatment apparatus 100 under the control from the control unit 160.

As illustrated in FIG. 10, a plurality of heads (four colors by four heads) may be provided as the inkjet head of the inkjet recording apparatus 170. Accordingly, the inkjet recording processing can be rapidly performed. At that time, in order to obtain, for example, the resolution of 1200 dpi at a high speed, the heads of different colors of the inkjet head are fixed while being deviated from each other so that the gap between the nozzles ejecting the ink is corrected. Further, several driving pulses of the driving frequencies are input to the heads of different colors so that the dot of the ink ejected from the nozzles corresponds to three kinds of quantity called large, middle, and small liquid droplets.

Further, it is effective to include the discharge electrodes 111 to 115 in that the plasma treatment is uniformly performed on the surface of the treatment target 20. That is, for example, when the same conveying speed (or the same printing speed) is set, it is possible to extend the time in which the treatment target 20 passes through the space of the plasma in the case where the plasma treatment is performed by the discharge electrodes compared to the case where the plasma treatment is performed by one discharge electrode. As a result, it is possible to further uniformly perform the plasma treatment on the surface of the treatment target 20.

Subsequently, the more specific configuration of the discharge electrode 110 of the plasma treatment apparatus 100 illustrated in FIG. 10 and the high-frequency and high-voltage pulse applied to the discharge electrode 110 will be described in detail with reference to the drawings.

As described above, in the plasma treatment for decreasing the pH value (hereinafter, referred to as a surface pH value) of the surface of the treatment target 20, plasma in atmosphere is irradiated to the treatment target 20 so that the organic component of the surface of the treatment target 20 is decomposed and oxidized into the molecule level, and an acidic functional group (a carboxyl group or the like) is coordinated on the surface.

Specifically, when the electrons in the vicinity of the discharge electrode 110 are accelerated within the electric field, the high-energy acceleration electrons increase in number while exciting the gas molecules in atmosphere, and hence a streamer discharge is generated. When the streamer discharge contacts the insulating material, a surface streamer discharge is generated. As a result, the surface of the treatment target 20 is widely reformed. During the surface streamer discharge, oxygen molecules $O_2$ or steam $H_2O$ in atmosphere are excited, and hence atomic oxygen, active species such as hydroxyl radical, or ozone $O_3$ is produced. The ozone also produces active species since atomic oxygen is disassociated when the ozone is returned to oxygen molecule $O_2$.

Since the active species produced as described above oxidize and decompose the organic component of the surface of the treatment target 20 and coordinate a carboxyl group COOH as an acidic functional group, the surface pH value of the treatment target 20 decreases. When an aqueous ink is struck on the treatment target 20 in which the surface pH value decreases, the pigment which is dispersed by the repelling action of minus charges in the ink liquid droplet is electrically neutralized by the hydrogen ion $H^+$ which is ionized while being disassociated from the carboxyl group. As a result, since the repelling action between the charges of the pigment particles disappear, the pigment is aggregated while causing a dispersion and a breakage. When the pigment is aggregated, the color component of the ink does not flow. For that reason, even when the ink is struck at the next time, the pigment is not mixed, and hence the ink dot is independently formed. As a result, the beading or the bleeding is suppressed.

The surface pH value of the treatment target 20 which is reformed by the plasma treatment according to the embodiment as described above may be checked by, for example, the astro pH tester pen S-5 manufactured by Nikken Chemical Laboratory Co., Ltd. The inventor and the like have found that the beading or the bleeding for a predetermined alkaline pigment ink is suppressed when the surface pH value of the treatment target 20 becomes 5 or less. Further, the inventor and the like have found that the beading or the bleeding is further suppressed when the surface pH value becomes 4.5 or less.

Further, the inventor and the like have found that the diameter (hereinafter, referred to as a discharge electrode diameter) of the discharge electrode 110 is desirably ϕ6 mm to ϕ10 mm. When the discharge electrode diameter becomes ϕ6 mm or less, the electrode is easily warped, and hence the discharge is not uniformly performed. Further, when the discharge electrode diameter becomes ϕ10 mm or more, the power consumption for the discharge increases.

Figure 11:
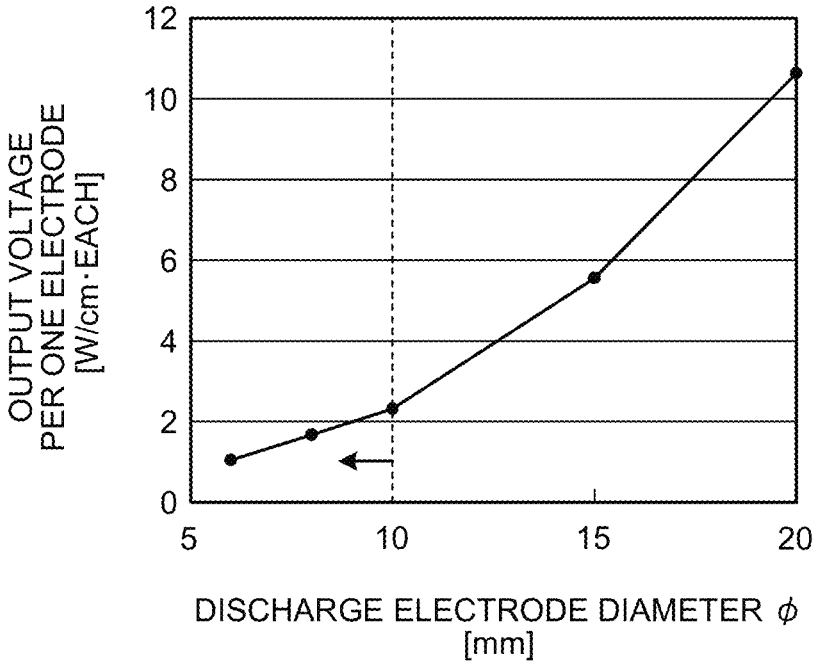
FIG. 11 is a graph illustrating a relation between the discharge electrode diameter and the output voltage per unit length of one discharge electrode of the embodiment.

FIG. 11 illustrates a relation between the discharge electrode diameter and the output voltage per unit length of the discharge electrode. As illustrated in FIG. 11, when the discharge electrode diameter becomes larger than ϕ10 mm, the output voltage increases, and hence the energy efficiency with respect to the pH decrease effect is degraded. This is because a capacitative reactance decreases when the discharge electrode diameter is large and a current which does not contribute to the discharge is consumed. From this background, the inventor and the like have found that the discharge electrode diameter is desirably ϕ10 mm or less.

Figure 12:
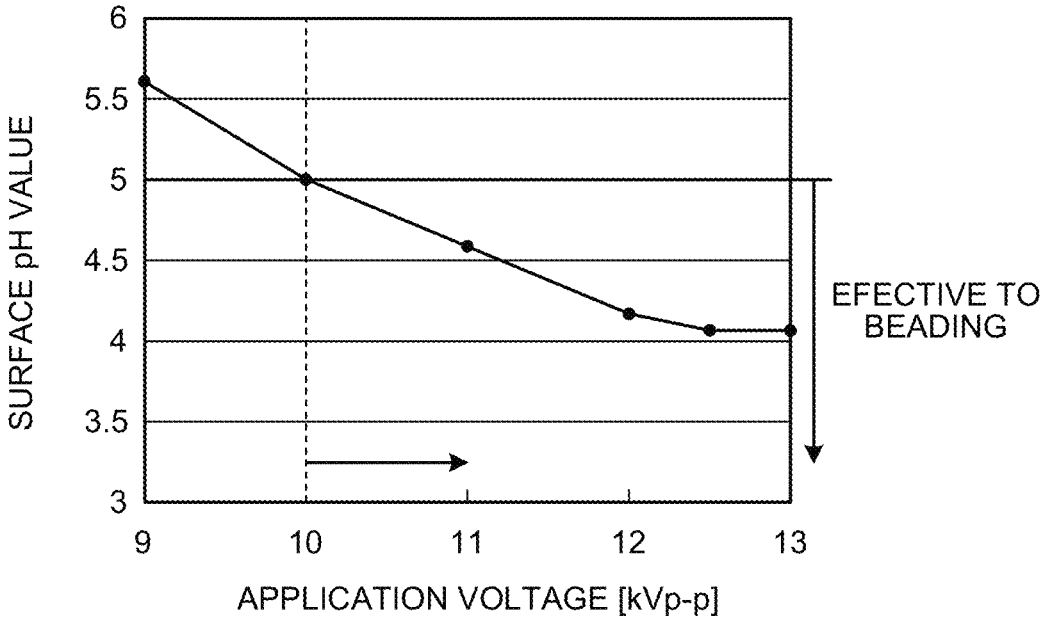
FIG. 12 is a graph illustrating a relation between an output voltage and a surface pH value of the embodiment.

Table 1 below is a table that indicates the surface pH value of the reformed treatment target 20 with respect to the output voltage of the high-frequency and high-voltage power source 150. FIG. 12 is a graph illustrating a relation between the output voltage and the surface pH value obtained from the result illustrated in Table 1. Here, a data is given when the discharge electrode diameter is ϕ8 mm.

TABLE 1

| | | | | | | |
|---|---|---|---|---|---|---|
| OUTPUT VOLTAGE [kVp-p] | 9 | 10 | 11 | 12 | 12.5 | 13 |
| PULSE FREQUENCY [kHz] | 20.2 | 20.2 | 20.2 | 20.2 | 20.2 | 20.2 |
| DISCHARGE ELECTRODE DIAMETER ϕ [mm] | 8 | 8 | 8 | 8 | 8 | 8 |
| OUTPUT VOLTAGE [W/cm · EACH] | 0.55 | 1 | 1.37 | 1.67 | 1.83 | 2 |
| DISTANCE BETWEEN ADJACENT DISCHARGE ELECTRODES [mm] | 2 | 2 | 2 | 2 | 2 | 2 |
| THICKNESS OF COUNTER DIELECTRIC BODY [mm] | 0.7 | 0.7 | 0.7 | 0.7 | 0.7 | 0.7 |
| pH VALUE OF COATED PAPER | 5.6 | 5.0 | 4.6 | 4.2 | 4.1 | 4.1 |

As illustrated in Table 1 and FIG. 12, it is found that the condition in which the surface pH value of the treatment target 20 becomes 5.0 or less so that the beading or the bleeding does not occur in a predetermined alkaline pigment ink is in the range where the output voltage is 10 kVp-p or more as a result that the output voltage is changed from 9 kVp-p to 13 kVp-p. Further, it is proved that the surface streamer discharge is not uniformly generated in the axial direction of each discharge electrode 110 and the process of reforming the treatment target 20 is not uniform in the range where the output voltage is 9 kVp-p or less. For this reason, it is proved that a satisfactory image can not be obtained at 9 kVp-p when the electrode diameter is ϕ8 mm even in the ink for which the pH value does not need to be 5 or less.

Further, the beading or the bleeding can be suppressed by further decreasing the surface pH value of the treatment target 20 with the application of the output voltage of 10 kVp-p or more. However, since the effect (hereinafter, referred to as a pH decrease effect) of decreasing the surface pH value is saturated in the range of 13 kVp-p or more, it is proved that the range is not desirable from the viewpoint of the energy efficiency. This is because the streamer discharge which is not used for the process of reforming the treatment target 20 is generated from the side surface of the discharge electrode 110 other than the surface streamer discharge below the discharge electrode 110 in the range of 13 kVp-p or more. From this background, the inventor and the like have found that the desirable output voltage is about 12.5 kVp-p. The inventor and the like have found that the range equal to or larger than 10 kVp-p and smaller than 13 kVp-p is the desirable range of the output voltage by performing the same experiment in the case where the discharge electrode diameter is ϕ6 mm to ϕ10 mm.

Figure 13:
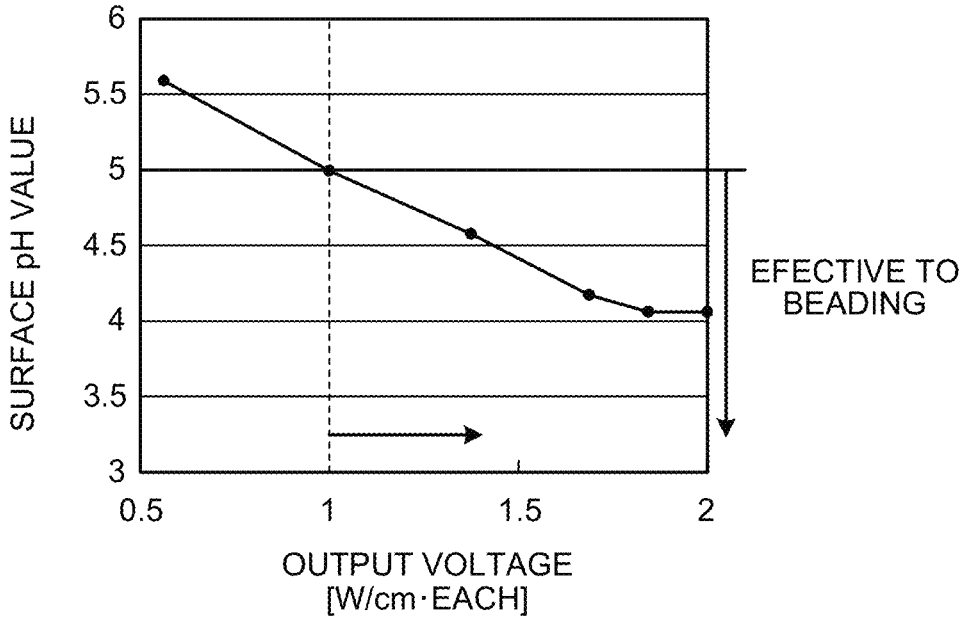
FIG. 13 is a graph illustrating a relation between the output voltage per unit length of one discharge electrode and a surface pH value of the embodiment.

Subsequently, FIG. 13 illustrates a relation between the output voltage per unit length of the discharge electrode and the surface pH value of the treatment target 20 obtained from the result illustrated in Table 1. As illustrated in FIG. 13, it is found that the condition in which the surface pH value of the treatment target 20 becomes 5.0 or less so that the beading or the bleeding does not occur is the range where the output voltage per unit length of the discharge electrode 110 is the range of 1 W/cm or more. Further, the beading or the bleeding can be suppressed by further decreasing the pH value in a manner such that the output voltage per each unit of the discharge electrode is set to 1 W/cm or more. However, since the pH decrease effect is saturated in the range of 2 W/cm or more, it is proved that the range is not desirable from the viewpoint of the energy efficiency. Therefore, the inventor and the like have found that the output voltage effectively decreasing the surface pH value of the treatment target 20 and reducing the useless power consumption is about 1.83 W/cm.

Figure 14:
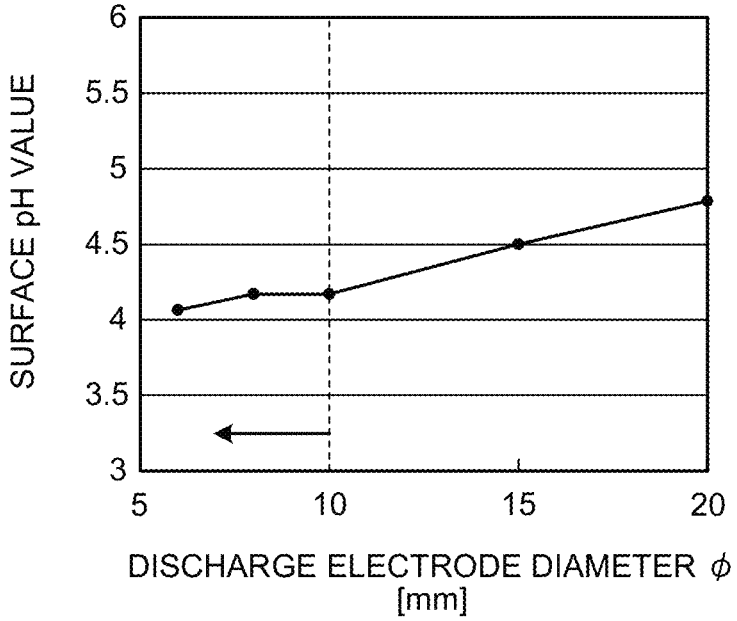
FIG. 14 is a graph illustrating a relation between a discharge electrode diameter and a surface pH value of the embodiment.

Subsequently, a relation between the surface pH value of the reformed treatment target 20 and the diameter (hereinafter, referred to as a discharge electrode diameter) of the discharge electrode 110 when two or more discharge electrodes are provided will be described. Table 2 below is a table that indicates a relation between the discharge electrode diameter and the surface pH value. FIG. 14 is a graph illustrating a relation between the discharge electrode diameter and the surface pH value obtained from the result illustrated in Table 2.

TABLE 2

| | | | | | |
|---|---|---|---|---|---|
| OUTPUT VOLTAGE [kVp-p] | 12 | 12 | 12 | 12 | 12 |
| PULSE FREQUENCY [kHz) | 20.2 | 20.2 | 20.2 | 20.2 | 20.2 |
| DISCHARGE ELECTRODE DIAMETER ϕ [mm] | 6 | 8 | 10 | 15 | 20 |
| OUTPUT VOLTAGE [W/cm · EACH] | 1.05 | 1.67 | 2.31 | 5.56 | 10.58 |
| DISTANCE BETWEEN ADJACENT DISCHARGE ELECTRODES [mm] | 2 | 2 | 2 | 2 | 2 |
| THICKNESS OF COUNTER DIELECTRIC BODY [mm] | 0.7 | 0.7 | 0.7 | 0.7 | 0.7 |
| pH VALUE OF COATED PAPER | 4.1 | 4.2 | 4.2 | 4.5 | 4.8 |

As illustrated in Table 2 and FIG. 14, the pH decrease effect is degraded with an increase in discharge electrode diameter in the range where the discharge electrode diameter is larger than ϕ10 mm. From this background, the inventor and the like have found that the discharge electrode diameter is desirably set to ϕ10 mm or less and more desirably set to ϕ8 mm or less.

Figure 15:
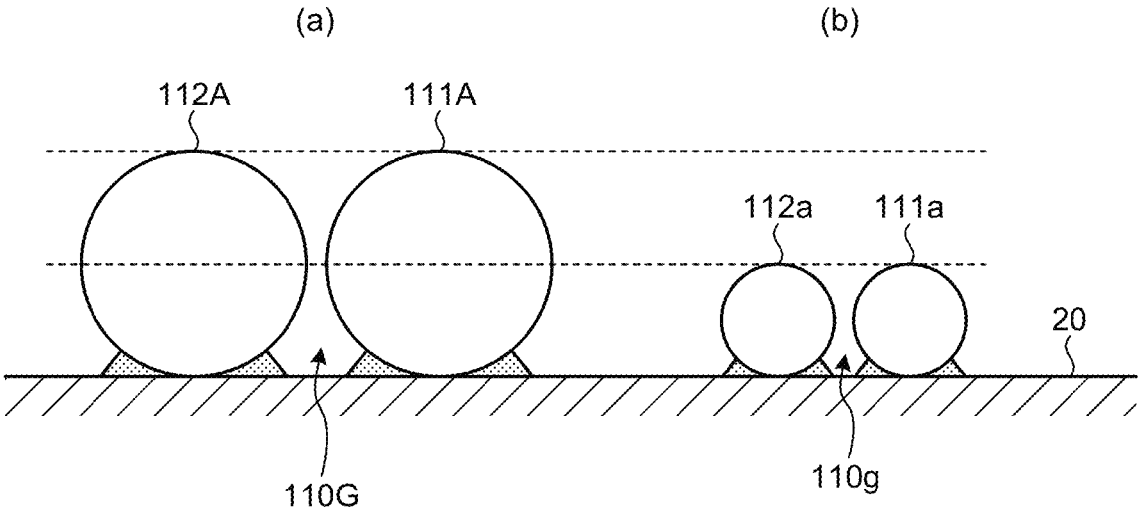
FIG. 15 is a diagram illustrating the size of a free space that is formed according to a difference in the size of a discharge electrode diameter of the embodiment.

Here, a relation between the discharge electrode diameter and the size of a space (hereinafter, referred to as a free space) formed below the discharge electrode will be described. FIG. 15 is a diagram illustrating the size of the free space formed according to a difference in the size of the discharge electrode diameter. Furthermore, FIG. 15(*a*) illustrates a case where the discharge electrode diameter is comparatively large, and FIG. 15(*b*) illustrates a case where the discharge electrode diameter is comparatively small. Further, in FIG. 15, the discharge electrode 110 is formed in a columnar shape, but the invention is not limited thereto. For example, the discharge electrode may be formed in a cylindrical shape when any deformation does not occur. Further, the shape may be modified into any shape as long as the vicinity of the treatment target 20 is tapered and a streamer discharge can be generated. Moreover, FIG. 15 illustrates an example of a contact type discharge in which the discharge electrode 110 contacts the treatment target 20, but the invention is not limited thereto. For example, a non-contact type discharge may be employed in which the discharge electrode 110 does not contact the treatment target 20.

As obvious from the comparison between a free space 110G illustrated in FIG. 15(*a*) and a free space 110*g* illustrated in FIG. 15(*b*), the free space 110G below discharge electrodes 111A and 112A increases in size as the discharge electrode diameter increases. For that reason, when the discharge electrode diameter is large, the active species generated by the surface streamer discharge is widely dispersed, and hence the possibility of the contact of the surface of the treatment target 20 decreases. On the contrary, as illustrated in FIG. 15(*b*), when the discharge electrode diameter is small, the free space 110*g* below the discharge electrode 111*a* and 112*a* is small, and hence the active species can be confined in the free space 110*g*. As a result, it is possible to increase the possibility of the contact between the treatment target 20 and the active species, and hence further efficiently reform the surface of the treatment target 20.

Figure 16:
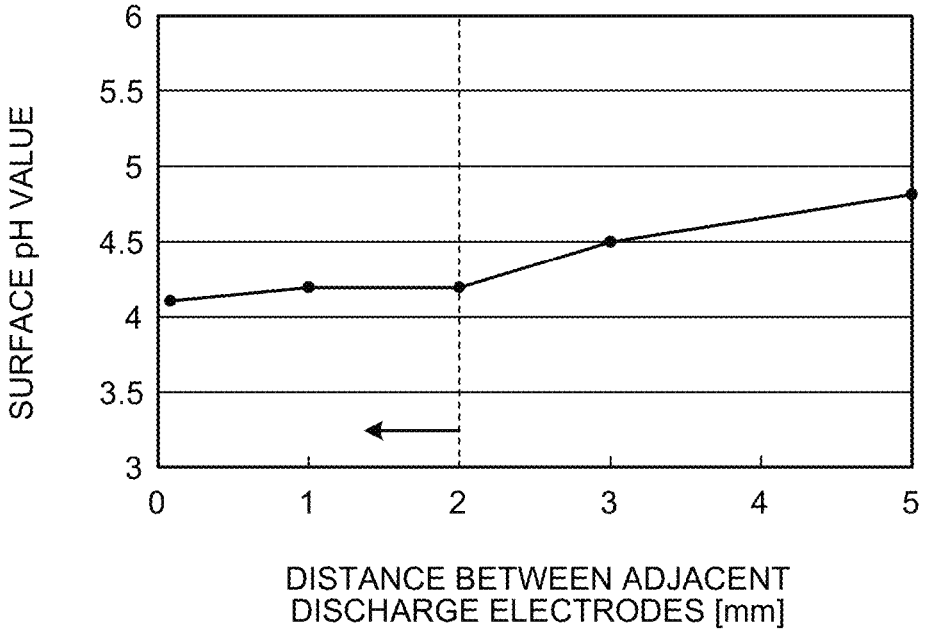
FIG. 16 is a graph illustrating a relation between a discharge electrode adjacence distance and a surface pH value of the embodiment.

Next, a relation between the surface pH value of the treatment target 20 and the distance (hereinafter, referred to as a discharge electrode adjacence distance) between the discharge electrodes 110 along the conveying path D1 will be described. Table 3 below is a table that indicates a relation between the discharge electrode adjacence distance and the surface pH value. FIG. 16 is a graph illustrating a relation between the discharge electrode adjacence distance and the surface pH value obtained from the result illustrated in Table 3.

TABLE 3

| | | | | | |
|---|---|---|---|---|---|
| OUTPUT VOLTAGE [kVp-p] | 12 | 12 | 12 | 12 | 12 |
| PULSE FREQUENCY [kHz) | 20.2 | 20.2 | 20.2 | 20.2 | 20.2 |
| DISCHARGE ELECTRODE DIAMETER ϕ [mm] | 8 | 8 | 8 | 8 | 8 |
| DISTANCE BETWEEN ADJACENT DISCHARGE ELECTRODES [mm] | 0.1 | 1 | 2 | 3 | 5 |
| THICKNESS OF COUNTER DIELECTRIC BODY [mm] | 0.7 | 0.7 | 0.7 | 0.7 | 0.7 |
| pH VALUE OF COATED PAPER | 4.1 | 4.2 | 4.2 | 4.5 | 4.8 |

As illustrated in Table 3 and FIG. 16, when the discharge electrode adjacence distance becomes larger than 2 mm, the pH decrease effect is degraded. This is because the active species leak from the gap between the discharge electrodes 110 and the contact efficiency with respect to the surface of the treatment target 20 is degraded. Therefore, the inventor and the like have found that the discharge electrode adjacence distance is desirably 2 mm or less.

Figure 17:
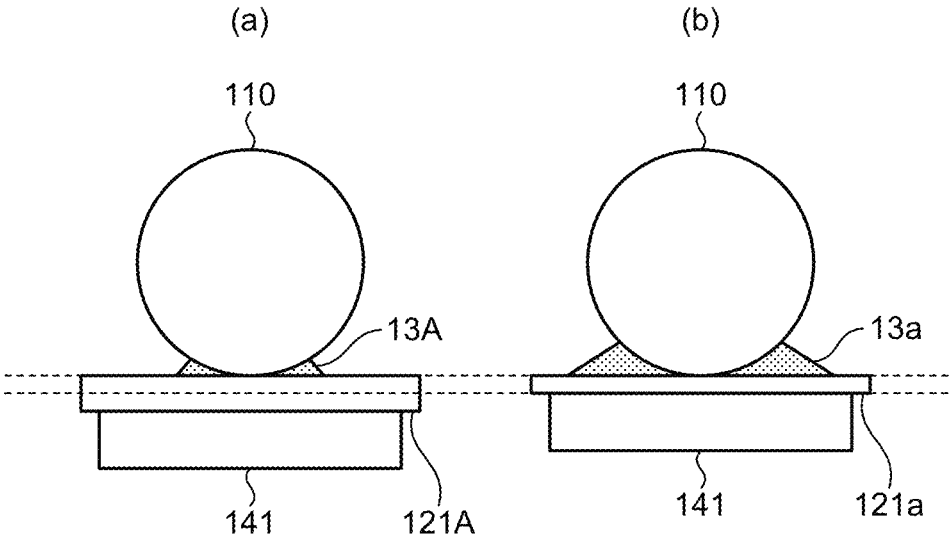
FIG. 17 is a diagram illustrating a relation between a dielectric body thickness and a discharge generation state of the embodiment.

Next, a relation between the discharge generation state and the thickness (hereinafter, referred to as a dielectric body thickness) of the dielectric body (the dielectric belt 121) interposed between the counter electrode 141 and the discharge electrode 110 will be described. FIG. 17 is a diagram illustrating a relation between the thickness of the dielectric body and the discharge generation state. Furthermore, FIG. 17(*a*) illustrates a case where the thickness of the dielectric body is comparatively thick, and FIG. 17(*b*) illustrates a case where the thickness of the dielectric body is comparatively thin.

As illustrated in FIG. 17(*a*), since the distance between the discharge electrode 110 and the counter electrode (the ground electrode) 141 increases and the development length of a surface streamer 13A decreases with an increase in the thickness of a dielectric body 121A, the pH decrease effect of the treatment target 20 is degraded. On the contrary, as illustrated in FIG. 17(*b*), since the development length of the surface streamer 13A increases when the thickness of the dielectric body 121*a* is thin, the pH decrease effect of the treatment target 20 can be improved.

Figure 18:
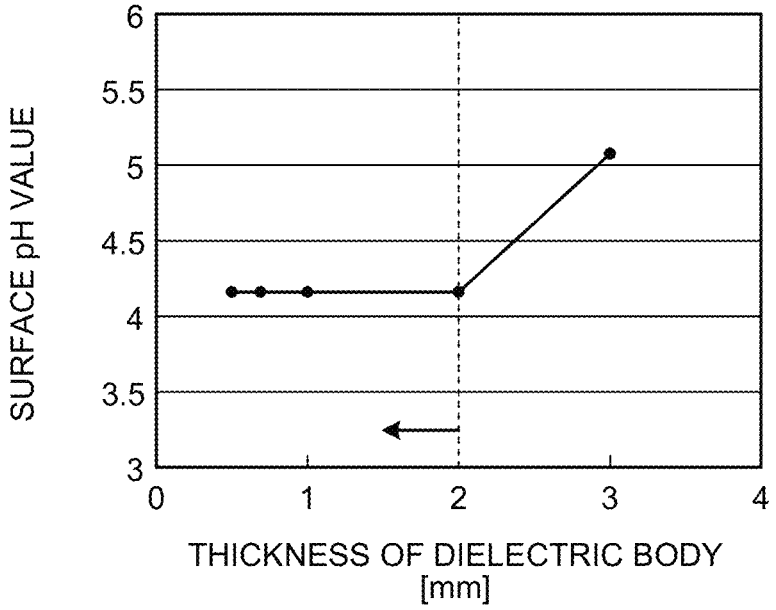
FIG. 18 is a graph illustrating a relation between a dielectric body thickness and a surface pH value of the embodiment.

Subsequently, a relation between the thickness of the dielectric body and the surface pH value of the treatment target 20 will be described. Table 4 below is a table that indicates a relation between the thickness of the dielectric body and the surface pH value. FIG. 18 is a graph illustrating a relation between the thickness of the dielectric body and the surface pH value obtained from the result illustrated in Table 4.

TABLE 4

| | | | | | |
|---|---|---|---|---|---|
| OUTPUT VOLTAGE [kVp-p] | 12 | 12 | 12 | 12 | 12 |
| PULSE FREQUENCY [kHz) | 20.2 | 20.2 | 20.2 | 20.2 | 20.2 |
| DISCHARGE ELECTRODE DIAMETER ϕ [mm] | 8 | 8 | 8 | 8 | 8 |
| DISTANCE BETWEEN ADJACENT DISCHARGE ELECTRODES [mm] | 2 | 2 | 2 | 2 | 2 |
| THICKNESS OF COUNTER DIELECTRIC BODY [mm] | 0.5 | 0.7 | 1 | 2 | 3 |
| pH VALUE OF COATED PAPER | 4.2 | 4.2 | 4.2 | 4.2 | 5.1 |

As illustrated in Table 4 and FIG. 18, when the thickness of the dielectric body becomes larger than 2 mm, the pH decrease effect of the surface of the treatment target 20 is degraded. Accordingly, the inventor and the like have found that the thickness of the dielectric body is desirably 2 mm or less and more desirably 1 mm or less.

Figure 19:
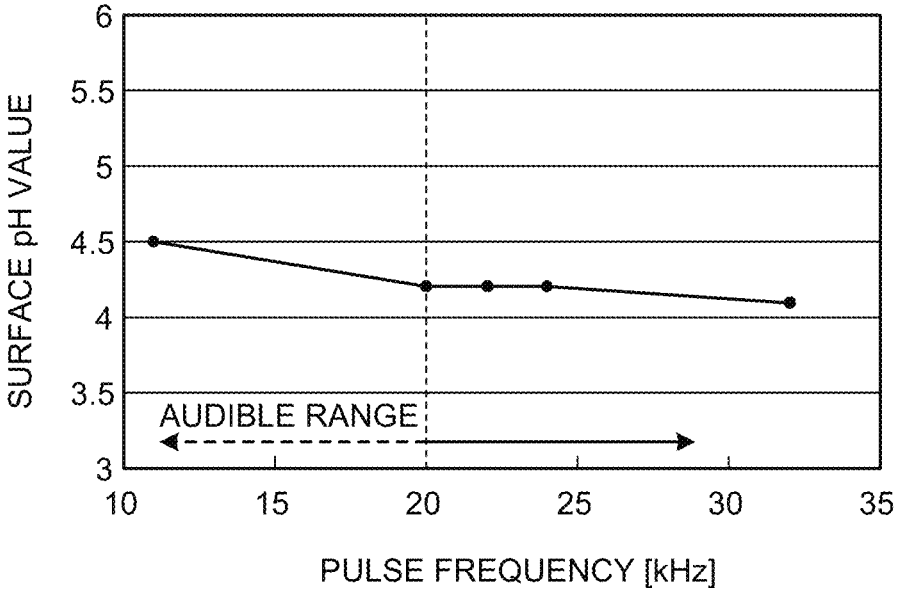
FIG. 19 is a graph illustrating a relation between a pulse frequency and a surface pH value of the embodiment.

Next, a relation between the pulse frequency of the output voltage and the surface pH value of the treatment target 20 will be described. Table 5 is a table that indicates a relation between the pulse frequency and the surface pH value. FIG. 19 is a graph illustrating a relation between the pulse frequency and the surface pH value obtained from the result illustrated in Table 5.

TABLE 5

| | | | | | |
|---|---|---|---|---|---|
| OUTPUT VOLTAGE [kVp-p] | 12 | 12 | 12 | 12 | 12 |
| PULSE FREQUENCY [kHz) | 11 | 20.2 | 22 | 24 | 32 |
| DISCHARGE ELECTRODE DIAMETER ϕ [mm] | 8 | 8 | 8 | 8 | 8 |
| DISTANCE BETWEEN ADJACENT DISCHARGE ELECTRODES [mm] | 2 | 2 | 2 | 2 | 2 |
| THICKNESS OF COUNTER DIELECTRIC BODY [mm] | 0.7 | 0.7 | 0.7 | 0.7 | 0.7 |
| pH VALUE OF COATED PAPER | 4.5 | 4.2 | 4.2 | 4.2 | 4.1 |

As illustrated in Table 5 and FIG. 19, when the pulse frequency is changed from 11 kHz to 34 kHz, there is a tendency that the pH decrease effect of the treatment target 20 increases depending on an increase in pulse frequency. This is because the output voltage increases and the plasma density of the surface streamer discharge increases when the pulse frequency increases. As a result, the pH decrease effect of the treatment target 20 increases. The pH decrease effect is sufficiently admitted in the range where the pulse frequency is at least 10 kHz or more. However, the discharge sound is located in an audible range in the frequency bandwidth of 20 kHz or less, and hence noise is generated. For that reason, it is desirable that the pulse frequency be 20 kHz or more.

According to an embodiment, it is possible to provide a treatment target reforming device, a printing apparatus, a printing system, and a printed material manufacturing method capable of manufacturing a high-quality printed material while suppressing an increase in cost.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A treatment target reforming device that decreases a pH value of a surface of a treatment target using a dielectric-barrier discharge, the treatment target reforming device comprising:

a discharge electrode and a counter electrode which are disposed so that a conveying path of the treatment target is interposed therebetween; and a power supply which applies a repetitive pulse voltage with an output voltage equal to or larger than 10 kVp-p and smaller than 13 kVp-p to the discharge electrode.

2. The treatment target reforming device according to claim 1, wherein the discharge electrode has a columnar or cylindrical shape with a diameter equal to or larger than 6 mm and equal to or smaller than 10 mm.

3. The treatment target reforming device according to claim 1, wherein the power supply applies the repetitive pulse voltage to the discharge electrode so that an output voltage per unit length of the discharge electrode becomes equal to or larger than 1 W/cm and equal to or smaller than 2 W/cm.

4. The treatment target reforming device according to claim 1, wherein the discharge electrode includes a plurality of discharge electrodes, and wherein a distance between the adjacent discharge electrodes is 2 mm or less.

5. The treatment target reforming device according to claim 1, further comprising:

a dielectric body which is disposed between the discharge electrode and the counter electrode, wherein a thickness of the dielectric body in a direction connecting the discharge electrode and the counter electrode is equal to or larger than 0.5 mm and equal to or smaller than 2 mm.

6. The treatment target reforming device according to claim 1, wherein the power supply applies the repetitive pulse voltage with a repetition frequency of 10 kHz or more to the discharge electrode.

7. The treatment target reforming device according to claim 1, wherein the power supply applies the repetitive pulse voltage with a repetition frequency of 20 kHz or more to the discharge electrode.

8. A printing apparatus comprising:

the treatment target reforming device according to claim 1; and a recording unit which performs inkjet recording on the surface of the treatment target subjected to pretreatment by a pretreatment unit is provided at subsequent to the treatment target reforming device.

9. A printing system comprising:

a treatment target reforming device which decreases a pH value of a surface of a treatment target using a dielectric-barrier discharge;

a recording device which performs inkjet recording on the surface of the treatment target reformed by the treatment target reforming device;

a discharge electrode and a counter electrode which are disposed so that a conveying path of the treatment target is interposed therebetween; and a power supply which applies a repetitive pulse voltage with an output voltage equal to or larger than 10 kVp-p and smaller than 13 kVp-p to the discharge electrode.

10. A printed material manufacturing method using a treatment target reforming device which decreases a pH value of a surface of a treatment target using a dielectric-barrier discharge and a recording device which performs inkjet recording on the surface of the treatment target reformed by the treatment target reforming device, the printed material manufacturing method comprising:

conveying the treatment target along a conveying path;

applying a repetitive pulse voltage with an output voltage equal to or larger than 10 kVp-p and smaller than 13 kVp-p to a discharge electrode and a counter electrode disposed so that the conveying path is interposed therebetween; and performing inkjet recording on the surface of the treatment target reformed by the applying.

* * * * *